United States Patent [19]

Martin

[11] Patent Number: 4,471,567

[45] Date of Patent: Sep. 18, 1984

[54] TWO-WAY OPERATING BALL ENCLOSED VEHICLE

[76] Inventor: John E. Martin, 5 Belfast Rd., Timonium, Md. 21093

[21] Appl. No.: 448,421

[22] Filed: Dec. 10, 1982

[51] Int. Cl.[3] ..... A63H 17/00; A63H 30/04

[52] U.S. Cl. ..... 446/437; 446/456; 446/439

[58] Field of Search ..... 46/202, 204, 206, 211, 46/212, 213, 251, 262, 263, 269, 100

[56] References Cited

U.S. PATENT DOCUMENTS

| | | | |
|---|---|---|---|
| 2,267,254 | 12/1941 | Reilley | 180/21 |
| 2,372,043 | 3/1945 | Aghnides | 180/171 |
| 3,312,013 | 4/1967 | Graves | 46/207 X |
| 3,474,565 | 10/1969 | Hanmer | 46/206 |
| 3,500,579 | 3/1970 | Bryer | 46/269 |
| 3,696,557 | 10/1972 | Ruppel | 46/253 |
| 3,722,134 | 3/1973 | Merrill et al. | 46/206 |
| 4,438,588 | 3/1984 | Martin | 46/228 |

FOREIGN PATENT DOCUMENTS

| | | | |
|---|---|---|---|
| 2115709 | 9/1983 | United Kingdom | 46/251 |

*Primary Examiner*—Robert A. Hafer
*Assistant Examiner*—William H. Honaker
*Attorney, Agent, or Firm*—John F. McClellan, Sr.

[57] ABSTRACT

A vehicle within a ball self-maneuvers to escape obstacles with which confronted, without need for special sensors or programmed response; the vehicle has four wheels, two in front and two behind, but the wheels are of two different tread widths, wider tread widths being one in front and, for example, one diagonally from it at the rear, and similarly narrower tread widths being supplied on the remaining two wheels; relation of the wheel spacing and ball inner diameter prevents more than three wheels from touching the ball at any one time; this, combined with tumbling causing the vehicle to operate upside down at times and initiated by stoppage of the ball at an obstacle, turns the vehicle as it oscillates within the ball and redirects the ball, freeing it from the obstacle.

14 Claims, 9 Drawing Figures

TWO-WAY OPERATING BALL ENCLOSED VEHICLE

Cross-reference is made to my copending U.S. Patent Application, Ser. No. 427,890, filed Sept. 29, 1982, for REMOTE CONTROL BALL.

FIELD OF THE INVENTION

This invention relates generally to toys and amusement devices and particularly to powered vehicles of the type.

PRIOR ART

In the prior art vehicles contained in shapes such as cylinders and spheres have been known, as indicated by the following patents:

U.S. Pat. Nos.

2,267,254 issued to J. E. Reilley on 12-23-41 disclosed a compound sphere structure with vehicle;

2,372,043 issued to E. Agnides on 3-20-45 disclosed a part-sphere part-cylinder enclosing a vehicle.

FOREIGNS

Great Britain—1,292,441 to J. T. Almond, Sept. 16, 1968, disclosed a spherical device with battery drive or with various kinds of motive power, inside steering, an overhead bracing wheel, a suggestion of use as a toy, and of remote control adaptation.

SUMMARY OF THE INVENTION

In spite of the prior art disclosures, no self-maneuvering ball or sphere system is known, particularly one which when it enters a corner or gets caught behind furniture or the like, powers itself free in a self-maneuvering mode, without need for sensors or programs, and to provide such is a principal object of this invention.

Further important objects are to provide a system as described which, in effect, seeks out obstacles to be escaped from, in which the vehicle supplied runs as well upside down as right side up but gives indication of in which orientation it is operating, and which can quickly and easily be adopted for different modes of action using snap-in components.

BRIEF DESCRIPTION OF THE DRAWINGS

The above and other objects and advantages of this invention will become more readily apparent on examination of the following description, including the drawings in which like reference numerals refer to like parts.

Figure 6:
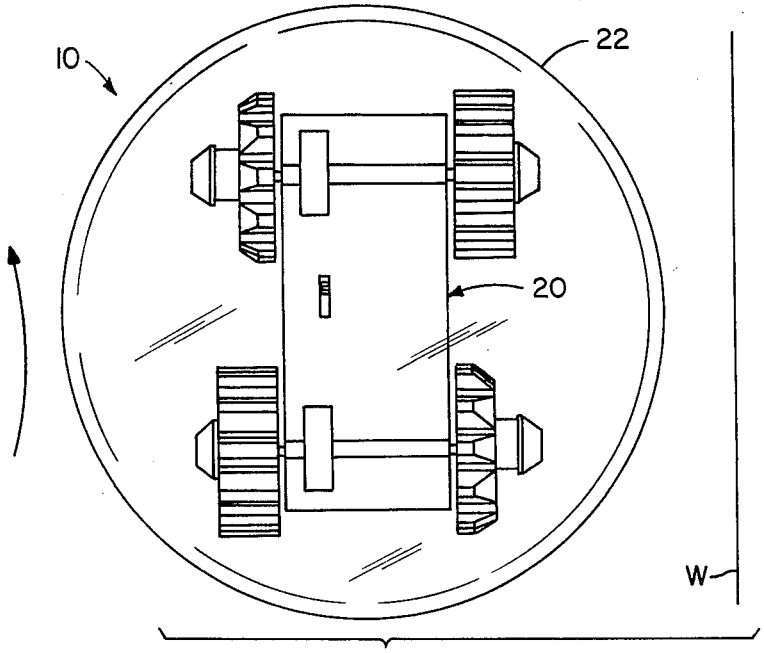

FIG, 5 is a top plan view of the ball generally corresponding to the second elevational view, showing a plan rotation of the vehicle produced by the constraint;

FIG. 6 is a top plan view of the ball showing the system escaping the obstruction.

Figure 7:
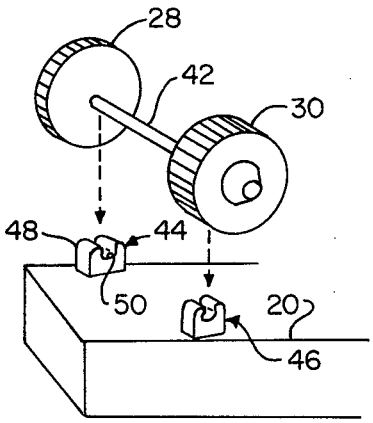
Figure 8:
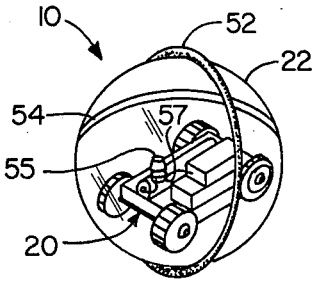

FIG. 7 is a perspective detail of an axle option;

FIG. 8 is a perspective detail of a ball option; and

Figure 9:
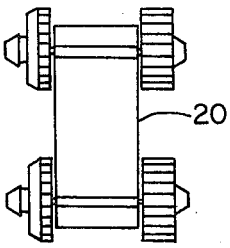

FIG. 9 shows in plan view an alternative wheel arrangement.

DETAILED DESCRIPTION

Figure 1:
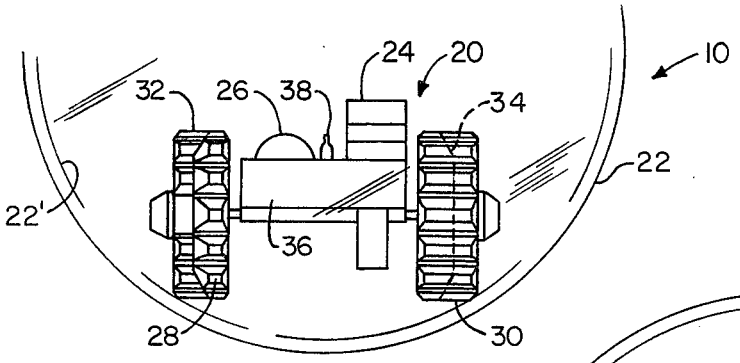
FIG. 1 is an end elevational view showing the vehicle and ball of this invention in fragmentary detail.

FIG. 1 shows the invention in embodiment 10 as comprising a special vehicle 20 within a transparent ball 2 which may have a clear spherical inside surface and may have a similar outside surface.

The vehicle 20 has a motor 24 powered by a battery 26 to drive the wheels 28, 30, 32, 34 and roll the system along a floor or the like. Prefereably all wheels drive. The front wheels 28, 30 are representative as shown.

They differ in width and in average lateral spacing of the tread part that contacts the sphere, the right front wheel 28 beng narrower and the tread or sphere-contacting spacing on the average is much closer to the vehicle body frame 36 than that of the left front wheel 30. The rear wheels may be just the reverse; the broad right rear wheel is indicated at 32 and the left rear wheel is shown in broken lines at 34. Center of gravity is mfre or less central in the vehicle.

Because of the wheel arrangement, even though the vehicle has four wheels, oely three can touch the sphere at one spacing of the wheels.

Light 38 may be a penlight self-focussing bulb supplied by the battery.

Figure 2:
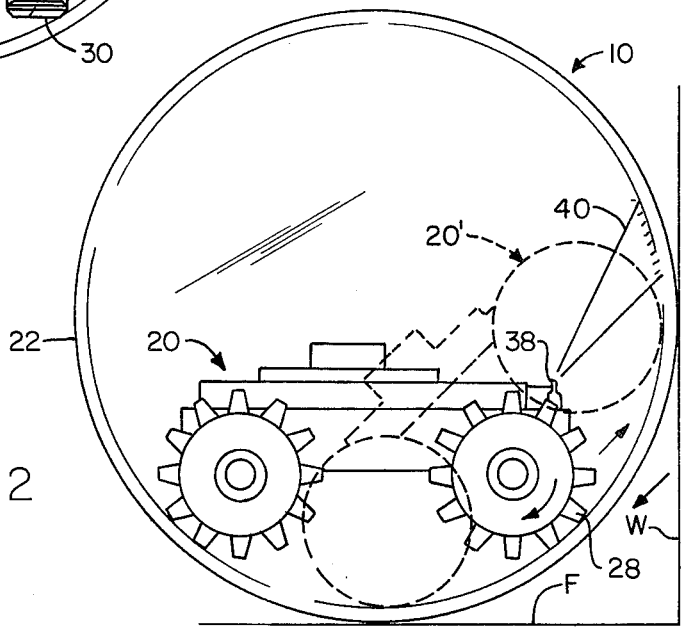
FIG. 2 is a side elevational view of the invention at an obstruction such as a wall, showing two successive rotational positions of the vehicle in elevation which may lead to escape from constraint by the obstruction.

FIG. 2 shows the invention 10 in side elevational view, the vehicle 20 climbing (upper arrow) a side of the ball 22 which is obstructed by a wall W or the like adjacent an intersection with a floor F on which the sphere rests. As indicated, the drive-wheel-contact farther out than the other, pulls on the ball farther out and turns it in the direction of that drive wheel contact.

The lower arrow indicates the reactive force on the ball 22 caused by rotation (arrow on wheel) of the drive wheels (28 shown).

The broken lines 20' indicate position of the vehicle 20 as result of climbing the ball, and just before the vehicle tumbles over backward. Light 38 shines on the ball as at 40 and can indicate which side of the vehicle is up. It shines forwardly and up or rearwardly and down depending on vehicle orientation. This may be a penlight supplied by the battery.

Figure 3:
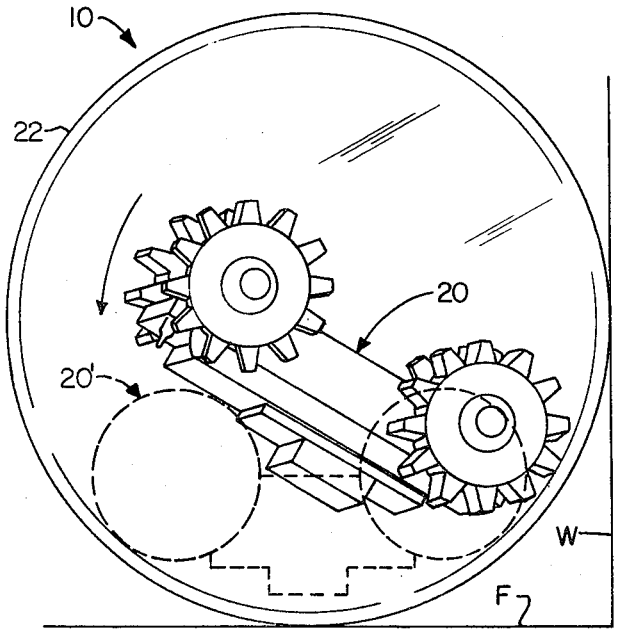
FIG. 3 is a side elevational view showing two further successive rotational positions of the vehicle in elevation which may lead to escape from the obstruction.

FIG. 3 shows the vehicle at 20 in a succeeding position to those of the previous Figure, tumbling over backwards and then (broken lines) at 20' beginning to climb again upside down.

When the vehicle tumbles end-for-end as in the previous Figure and this one, the wider-to-the-side contact point (contacting wheel) shifts from left to right at the front and from right to left at the rear, setting up a rocking motion or oscillation tending to redirect the ball and free it from the constraint by any obstacle such as the wall W.

Figure 4:
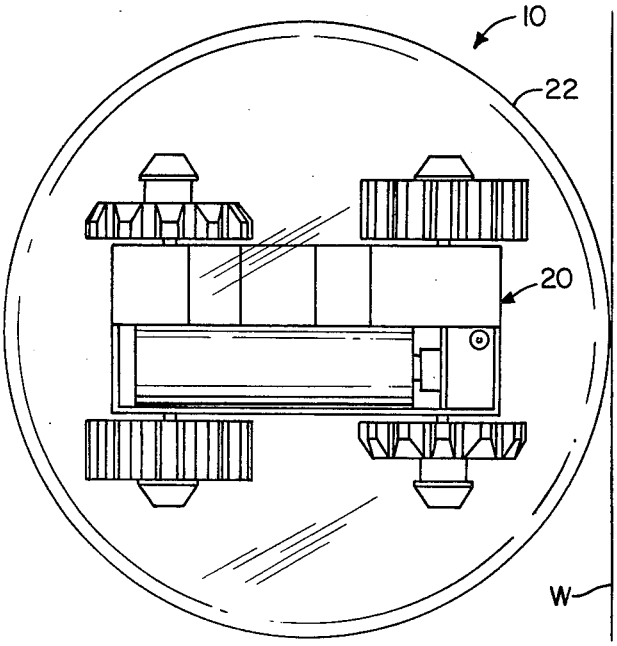
FIG. 4 is a top plan view generally corresponding to the first side elevational view.

FIG. 4 shows the vehicle 20 in plan view head-on to the wall W, within the ball 22, which is against the wall W, where the vehicle has driven it. This view corresponds generally to the second Figure above.

Figure 5:
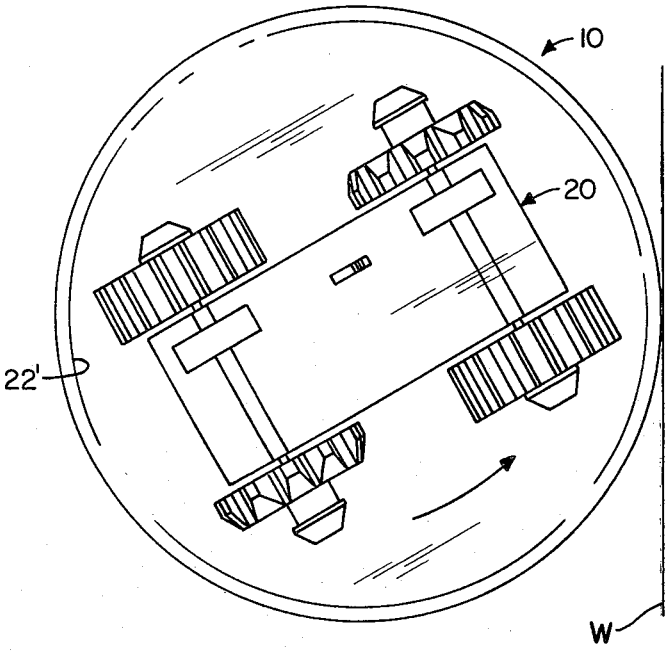

FIG. 5 shows the vehicle 20 at an angle (45° approximately) to the wall W as it tumbles and turns (arrow) and works around by climbing the wall interior surface 22'.

FIG. 6 shows the vehicle 20 pointing parallel with the wall W and moving the ball 22 along free of the wall, or perhaps the movement will be a bumping along the wall, but the vehicle will not return to the head-on position to the wall and the ball will continue to progress along the wall.

Eventually, the ball will leave the wall and describe a large circle (arrow) perhaps engaging and freeing itself from other objects in the process. The vehicle tends to turn the ball different ways, as indicated, depending on which set of the modified wheel pairs is in front, this being changed each time the vehicle tumbles, which is frequent or continual when confronted with an obstacle. Rolling of the vehicle on the other hand is very unusual and requires that the ball fall down a step or the like, or rolling can be produced manually.

FIG. 7 shows that the wheels (28, 30 shown) can be put on either way (large wheel to left or to right, for example) by providing, and snapping the axle 42 into place in, notched journals 44, 46 on the vehicle 20. The notched journals have semi-closed jaws 48 at the part of the opening through which the axle must pass to reach the full size axle-fitting openings 50.

The journals may, as shown, angle the axles obliquely to the fore-and-aft axis of the vehicle if desired, for building in more circular motion of the vehicle. On end-over-end re-orientation with only one axle angled, the invention will desirably redirect itself as described, in response also to this oblique steering angle.

FIG. 8 shows a further variation on the system, a ring 52 such as an "O" ring or a piece of $\frac{1}{4}$ inch (6 mm) rubber tubing cemented or otherwise fastened around a circumference.

This can guide the ball so that is rolls in circles under urging of the vehicle 20.

The ball may be of hard plastic and in two halves, held together by a piece of tape 54, or the halves may screw together or snap together.

A potentiometer 55 may be conventionally wired in the battery circuit 57 indicated (a series circuit battery-to-motor) for speed control, if desired. Also, a soft ball may be used but must not be soft enough to permit drag of the motor on the ball when the vehicle inverts, which is just avoided by the dimensions given.

FIG. 9 shows a variation in which both wheels are asymmetrical in the same way relative to the vehicle frame. This will produce a curved path for a ball but is not preferred as end-over-end turning wll not produce the desired positive degree of re-direction. Also, both wheels of one of the pairs could be the same but this is not preferred. Further, the vehicle could be two wheel drive, but this is not preferred; the action would be less positive and vigrorous, particularly in view of the incline to be climbed in the ball for flip-over or end-over-ending.

Specifications of the system may be as follows: the ball may be of hard clear plastic, 4 inches (10 cm) outside diameter and $3\frac{7}{8}$ inches (9.8 cm) inside diameter. It may be in halves, taped together.

The vehicle may be any one of the "jeep" models Nos. 6213, 6256, 6257, 6260, made in Macao and distributed by LJN Toys Ltd. of New York City under the name ROUGH RIDERS 4×4. These are four wheel drive vehicles having simulated broad, lugged tires and using one size AA battery, and for purposes of this invention are partially dismantled and otherwise modified. The body is so removed so that the vehicle will operate in the ball either upside down or right side up. The motor and battery are taped in place, leaving the on-off switch on the underside accessible. Two of the wheels which are diagonally opposed, for example the right front and the left rear, are trimmed to take off tread of the wheels.

Dimensions as adapted for this invention are substantially:

length $2\frac{7}{8}$ inches (7.3 cm)
width $2\frac{1}{4}$ inches (5.7 cm) (over the hubs)
width $1\frac{3}{4}$ inches (4.5 cm) (over the treads)
width of body 1 inch (2.5 cm)
normal tire-width $\frac{3}{8}$ inch (0.9 cm)
trimmed tire-width $\frac{1}{8}$ inch (0.3 cm)
center distance, axle $1\frac{3}{4}$ inches (4.4 cm)
wheel diameter, 1 inch (2.5 cm)
height above each axle level may be 182 inch (1.9 cm) along one side of the body; this provides good clearance still in the ball.
weight 1 oz (28 gms)

The tires are of soft elastomeric material and the ball may be of polystyrene or the like. The vehicle body has two headlights in conventional location, supplied by a light bulb in the upper front of the vehicle and some light-conducting structure on the body.

It will be appreciated that the asymmetry at the long axis and the end-over-ending or inverting capability, which dynamically change relations of vehicle and ball, may be part of means for freeing the vehicle from obstacles. Also, as part of the same, may be the means for preventing more than three wheels from contacting the interior surface of the ball at one time (that is, the geometrical relation of vehicle wheels and ball to which the wheel wide-and-narrow perimeter widths and differing ball contacting spans as measured from the frame of the vehicle, contribute).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of vehicle within ball and means powering the vehicle through a plurality of drive wheels for driving against a compoundly curved surface within the ball and rolling said system along floors and the like, the improvement comprising: means for freeing the vehicle from obstacles such as walls encountered in said rolling, including: means for providing asymmetric drive of the ball by said plurality of wheels, and means for varying said asymmetric drive when the ball is retarded by an obstacle.

2. In a system as recited in claim 1, the means for providing asymmetric drive including said plurality of wheels comprising a pair of front wheels and a pair of rear wheels, at least one of said pairs of wheels being assymetric relative to said vehicle and said means for varying including means adapting said vehicle for inverting end-over-end when the ball is retarded.

3. In a system as recited in claim 1, said means for providing asymmetric drive including means for preventing more than three of said wheels from contacting said surface at any one time.

4. In a system as recited in claim 2, said wheel asymmetry comprising both said pairs of wheels being asymmetric relative to said vehicle.

5. In a system as recited in claim 2, said wheel asymmetry comprising at least one of said pairs of wheels having a peripheral tread on a said wheel narrower than that of the other said wheel of said pair.

6. In a system as recited in claim 2, said wheel asymmetry comprising each of said pairs of wheels having a wheel with a peripheral tread narrower than that of the other wheel of said pair of wheels.

7. In a system as recited in claim 6, the wheel with narrower peripheral tread in said pair of front wheels being on a first side of the vehicle and the wheel with narrower peripheral tread in said pair of rear wheels being on a second side of the vehicle.

8. In a system as recited in claim 2, said wheel asymmetry including: a wheel of at least one of said pairs of wheels being located for contacting the surface at a position farther from the vehicle than the other wheel of said pair of wheels.

9. In a system as recited in claim 2, said wheel asymmetry including a first wheel of each of said pairs of wheels being located for contacting the surface at a position farther from the vehicle than the second wheel of each of said pairs of wheels.

10. In a system as recited in claim 2, said wheel asymmetry including at least one of said wheels having an axle, and means for holding said axle at an oblique steering angle relative to said vehicle.

11. In a system as recited in claim 10, said means for holding including a notched journal with a jaw providing snap-in retention of said axle.

12. In a system as recited in claim 2, said vehicle being a four-wheel drive vehicle.

13. In a system as recited in claim 2, means for guiding said ball to roll in a circle, comprising a protrusive ring around said ball.

14. In a system as recited in claim 2, said vehicle having a light, said light oriented to either point forwardly and upwardly or rearwardly and downwardly depending on orientation of the vehicle during said driving of the ball.

* * * * *